US006235391B1

(12) United States Patent
Contreras et al.

(10) Patent No.: US 6,235,391 B1
(45) Date of Patent: May 22, 2001

(54) FILLING MATERIAL FOR CUSHIONS

(75) Inventors: Jose D. M. Contreras, Compton, CA (US); Denys Denney, Bear, DE (US); Vincent Scattolino, Lester, PA (US)

(73) Assignee: Foamex L.P., Linwood, PA (US)

( * ) Notice: Subject to any disclaimer, the term of this patent is extended or adjusted under 35 U.S.C. 154(b) by 0 days.

(21) Appl. No.: 09/440,532

(22) Filed: Nov. 15, 1999

Related U.S. Application Data

(63) Continuation-in-part of application No. 09/017,962, filed on Feb. 3, 1998, now abandoned.

(51) Int. Cl.[7] ..... D01F 6/70

(52) U.S. Cl. ..... 428/367; 428/371; 428/377; 428/304.2

(58) Field of Search ..... 428/304.2, 369, 428/371, 377

(56) References Cited

U.S. PATENT DOCUMENTS

| | | | |
|---|---|---|---|
| 3,074,543 | | 1/1963 | Stanley . |
| 3,188,264 | | 6/1965 | Holden . |
| 3,251,728 | | 5/1966 | Humbert et al. . |
| 3,426,372 | | 2/1969 | Enelow . |
| 3,481,455 | | 12/1969 | Graham . |
| 3,608,961 | | 9/1971 | Von Heck . |
| 3,922,756 | | 12/1975 | Ogasawara et al. . |
| 3,999,801 | | 12/1976 | Walters . |
| 4,027,064 | | 5/1977 | Bussey, Jr. . |
| 4,052,346 | * | 10/1977 | Rudner ..... 260/2.5 AM |
| 4,109,332 | | 8/1978 | Luck . |
| 4,147,825 | | 4/1979 | Talalay . |
| 4,215,166 | | 7/1980 | Bussey, Jr. . |
| 4,241,832 | | 12/1980 | Bliss . |
| 4,252,910 | | 2/1981 | Schaefer . |
| 4,482,582 | | 11/1984 | Weisman . |
| 4,754,511 | | 7/1988 | Sargent . |
| 4,758,466 | | 7/1988 | Dabi et al. . |
| 4,845,133 | | 7/1989 | Priester, Jr. et al. . |
| 4,924,541 | | 5/1990 | Inagaki . |
| 4,956,886 | | 9/1990 | Sarkozi . |
| 4,998,309 | | 3/1991 | Tesch . |
| 5,061,737 | | 10/1991 | Hudson . |
| 5,169,580 | | 12/1992 | Marcus . |
| 5,439,730 | | 8/1995 | Kelly et al. . |
| 5,458,971 | | 10/1995 | Hernandez et al. . |
| 5,571,465 | | 11/1996 | Gill et al. . |
| 5,608,936 | | 3/1997 | Normura . |

FOREIGN PATENT DOCUMENTS

| | | |
|---|---|---|
| 04124179 | 2/1992 | (DE) . |

* cited by examiner

*Primary Examiner*—N Edwards
(74) *Attorney, Agent, or Firm*—Connolly Bove Lodge & Hutz LLP

(57) ABSTRACT

A resilient material shaped into a bent strand with a preferred length from 1.5 to 7 inches forms a filling element for cushions, pillows and upholstered articles. The strand may be bent so as to have a Z-shape or an S-shape or a V-shape or a C-shape along a portion of its length. The length of the strand is greater than its nominal cross-sectional thickness. A quantity of filling elements (e.g., the filling material), preferably formed from flexible, open cell polyurethane foam, is inserted or blown into a casing for a cushion, pillow or upholstered article. Following compression, the filling elements rebound substantially to their uncompressed state without clumping together or leaving pockets within the casing.

19 Claims, 1 Drawing Sheet

FILLING MATERIAL FOR CUSHIONS

CROSS-REFERENCE TO RELATED APPLICATIONS

This application is a continuation-in-part of application Ser. No. 09/017,962, filed Feb. 3, 1998, now abandoned.

This invention relates to filling materials packed or blown into fabric enclosures to form cushions, upholstered cushioning, comforters, and pillow cores.

BACKGROUND OF THE INVENTION

Conventional pillows are usually filled with a cushioning filler material of cotton wadding or batting, feathers, down, sponge rubber, fiber fill or foam. Among these materials, down shows excellent properties in bulkiness, softness, thermal insulation, compression recovery and moisture transmission. Many people, however, are allergic to down, and down may harbor not only allergens, but also insects and bacteria. Down is also cost prohibitive for many applications.

Cotton, compared with down, has inferior bulkiness, softness and thermal insulation. Its compression recovery is not as good as down or some of the synthetic filling materials. When damp, the cotton wads together and does not sufficiently recover to its uncompressed state.

The synthetic materials have advantages over the natural materials, in view of cost, durability and health concerns. Polyester fiber fill is an especially popular filling material. Other synthetic fibers used as fillers include polyethylene, polypropylene, polyamide and aramides. A matrix of straight fibers is pre-fluffed with a picker apparatus to separate the fibers to permit their insertion into a cushion or pillow casing. The fibers are then blown through an injector or plurality of injectors into cavities formed in the casing. With cushion use, fibers tend to bunch up and create pockets which permit the cushion or pillow to "bottom out". Particularly, it has been found that fibers nest and clump together when blown into larger volume casings or casings with complicated shapes. Thus, in an effort to prevent undue clumping of fibers, larger or more complicated cushions are separated by ticking into several smaller compartments that are filled with the fibers.

To eliminate some of the crushing and clumping associated with straight fiber filling materials, U.S. Pat. No. 3,922,756 proposes forming the fibers into a filamentary spherical body. Spherically intertwined fiber aggregates also are shown in U.S. Pat. Nos. 4,998,309 and 4,794,038.

In lieu of fiber fill, blocks of sponge rubber or foam may be shredded into chunks or particles that are used as filling materials for cushions and pillows. The edges of the shredded foam chunks tend to hook together, which creates regions with more foam and regions with less foam within the cushion core. The foam chunks or particles do not reproduce the cushioning plushness of fiber fill or down.

To address the clumping problems associated with fibers, U.S. Pat. No. 5,061,737 suggests combining fiber fill (1–3 inch long fibers) with shredded polyurethane foam chips (¼ inch blocks) to form a filling material. The fibers are coated or slickened with a silicone finish prior to mixing with the shredded foam. The patent states that the length and diameter of the fibers relative to the size of the foam chips and the limited movement permitted by the slickened fiber surfaces affords adequate cushioning support while still maintaining the cushion shape.

U.S. Pat. No. 4,109,332 proposes using polyurethane foam cut into polygonal shaped rods. The rods have flat planar top, bottom and side surfaces, and preferably have a length and width proportionally greater than the rod thickness (or height). The patent emphasizes the importance of the planar nature of the side areas to prevent the rods from hooking on to one another when used as a filling for cushions.

Other synthetic filling materials include engineered elastomeric spheres, U.S. Pat. Nos. 4,754,511 and 5,608,936, pebbles or beads, U.S. Pat. Nos. 3,608,961 and 3,999,801, or tubular hollow forms.

To date, the prior art has not shown cellular polymer or flexible foam filling materials that can be readily inserted by blowing or other means into the chambers of cushion, upholstery cushion and pillow casings without the need for additional ticking or compartments, that repeatedly recover from compression, that avoid clumping and nesting thereby preventing pockets and "bottoming out", and that may be made economically as compared to prior filling materials.

SUMMARY OF THE INVENTION

A filling element for a cushion, pillow, or upholstered article is formed from a resilient material, such as flexible, open cell foam, shaped into a bent strand. The strand preferably has a portion along its length that is Z-shaped, V-shaped, C-shaped or S-shaped. The resilient material may be formed to have a combination of these shapes along different portions of the strand length.

In the preferred embodiment, the strand has a distal end, a proximal end and a length measured as the distance between the distal end and the proximal end. The strand has a substantially constant cross-sectional thickness along its length. In all cases, the length of the strand is substantially greater than its nominal cross-sectional thickness. Preferably, the length of the strand is about 5 to 20 times greater than the nominal cross-sectional thickness of the strand. In addition, the individual sections making up the strand length also have a length greater than the nominal cross-sectional thickness of the strand.

The strand is formed with at least one bend along its length. Preferably, the bend is at an angle of between about 15 to about 120 degrees, most preferably about 30 to about 40 degrees.

The filling element may be formed from a strand with a Z-shape. In this case, the strand has generally straight legs or leg sections depending at bent angles from a generally straight center section. The legs terminate at the distal end and proximal end, respectively. These ends have generally planar faces. The planar faces of the distal and proximal ends may be cut at an angle perpendicular to the sidewalls of the legs. Preferably, the planar faces of the ends are cut at an angle other than perpendicular to the sidewalls of the legs, such that the faces each have a cross-sectional areas greater than the nominal cross sectional area of the corresponding leg.

The filling element may be formed from a strand with an S-shape. In such case, the strand has generally curved legs depending at bent angles from a generally curved center section. The legs terminate at the distal end and proximal end, respectively. These ends have generally planar faces. The planar faces of the distal and proximal ends may be cut at an angle perpendicular to the sidewalls of the legs. Preferably, the planar faces of the ends are cut at an angle other than perpendicular to the sidewalls of the legs, such that the faces each have a cross-sectional areas greater than the nominal cross sectional area of the corresponding leg.

The resilient material is a cellular polymer material, preferably flexible, open cell polyether or polyester polyurethane foam. When a polyurethane foam is used, the foam has a density in the range of about 0.6 to about 1.2, preferably about 0.8 to about 1.0 pounds per cubic foot, and an indentation force deflection (IFD) in the range of about 4 to about 15, preferably about 8 to about 12 pounds.

DESCRIPTION OF THE PREFERRED EMBODIMENT

Cushions, pillows and upholstered articles may be formed by blowing a filling material, such as polyester fiber fill, into a casing. The preferred method blows the filling elements with a gas stream, such as air. The casing is then sealed or sewn together to form the cushion or cushioning interior of the cushion, pillow or upholstered article. The filling elements of the present invention may be blown into cushion casings using the same blowing apparatus used for fiber fill.

Figure 1:
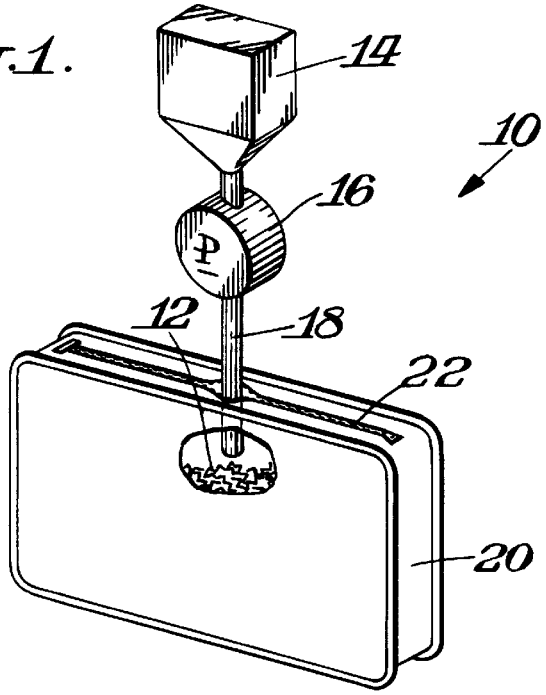
FIG. 1 is a schematic diagram showing a plurality of filling elements of the invention as they are blown into a casing to form a cushion.

As shown in FIG. 1, the apparatus 10 to fill a casing includes a supply hopper 14, a blower 16 and an inserting pipe or tube 18. The filling material 12, which is a plurality of the filling elements according to the invention, is placed into the supply hopper 14 and blown from the hopper 14 through the pipe 18 and into the casing 20 by blower 16. If not sewn together after it is filled, the cushion casing may be supplied with a zipper 22 or other fastening means.

Figure 2:
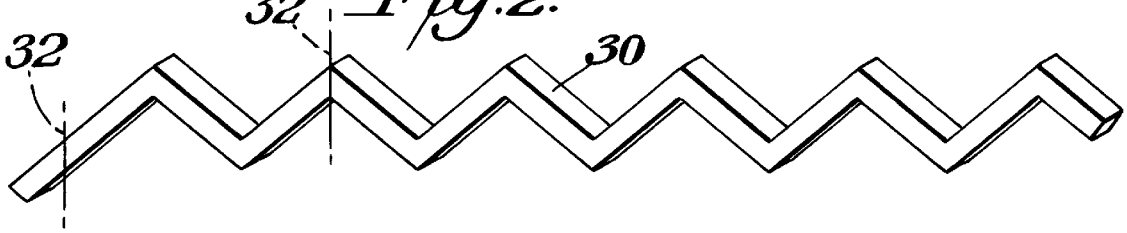
FIG. 2 is perspective view of a strip of resilient material prior to cutting to a desired strand length.

A resilient material, such as flexible open cell polyurethane foam, is cut, such as by a rotary cutter, or otherwise formed into a bent strand to form a filling element according to the invention. As shown in FIG. 2, the material may be formed into a long continuous strand 30 having a plurality of generally straight sections interconnected together at their ends to form bent angles alternating upwardly and downwardly.

Figure 3:
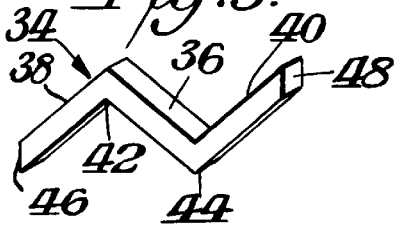
FIG. 3 is a perspective view of a piece of resilient material of FIG. 2 cut to a desired strand length to form a filling element according to the invention.

Individual filling elements are formed by cutting sections from the long strand 30. Filling element 34 (shown in FIG. 3) is formed by cutting long strand 30 at lines 32. The filling element 34 has a proximal end 46 and a distal end 48 and a length measured as the distance between the proximal and distal ends.

The Z-shaped filling element 34 has a generally straight center section 36 with generally straight left leg section 38 and generally straight right leg section 40 depending therefrom. The center section 36 and left leg section 38 form a bent angle 42 therebetween. The center section 36 and right leg section 40 form a bent angle 44 therebetween. Preferably, the angles formed between the center section 36 and the leg sections 38, 40 are in the range of about 15 to 120 degrees, most preferably about 30 to 40 degrees. Although shown to be equivalent in FIG. 3, the angle 42 may be the same as or different from the angle 44.

The left leg section 38 terminates at a proximal end 46 with a planar face having a rectangular cross section. The right leg section 40 terminates at a distal end 48 with a planar face having a rectangular cross section. As shown in FIG. 2, the cut lines 32 are taken through the strand 30 at points at which two generally straight sections meet at an angle. As a consequence of these cuts, which are at oblique angles relative to the side walls of the generally straight sections, the planar faces at the proximal and distal ends 46, 48 have cross sectional areas that are greater than the nominal cross sectional area of the corresponding leg sections 38, 40. Had the cut lines been taken perpendicular to the sidewalls of a leg section, the planar faces at the proximal and distal ends of the filling element would have had cross sectional areas equivalent or nearly equivalent to the cross sectional area of the corresponding leg sections.

The filling element 34 has a length, as measured from the farthest extended portion of the proximal end 46 to the farthest extended portion of the distal end 48, in the range of about 1.5 to 7 inches. Preferably, the length of the filling element does not exceed 5 inches. It has also been found that the length should be at least 2 inches for many applications to avoid many of the clumping and nesting problems attributed to shredded foam of the prior art. In the particularly preferred embodiment, the center, left leg and right leg sections are of substantially equal length. A particularly preferred section length is between about 1 to 2 inches, most particularly 1.25 inches.

Figure 5:
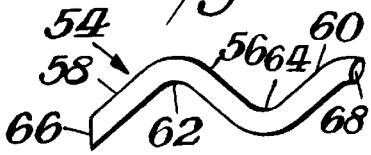
FIG. 5 is a perspective view of a piece of resilient material of FIG. 4 cut to a desired strand length to form a filling element according to the invention.
Figure 4:
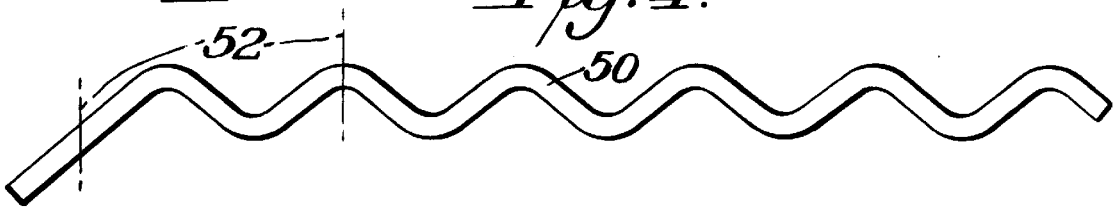
FIG. 4 is a perspective view of a strip of an alternate resilient material prior to cutting to a desired strand length.

FIGS. 4 and 5 relate to an alternate embodiment of the invention. FIG. 4 shows a long strand of resilient material 50 having a series of alternating upwardly curved sections and downwardly curved sections. The strand 50 is cut at cut line 52 to form filling element 54 shown in FIG. 5.

The S-shaped filling element 54 has a center section 56 disposed between a left leg section 58 and right leg section 60. The place at which the center section 56 meets the left leg section 58 forms a downwardly bent angle 62. The place at which the center section 56 meets the right leg section 60 forms an upwardly bent angle 64. The left leg section 58 terminates at proximal end 66 having a planar face, and the right leg section terminates at a distal end 68 having a planar face. The planar faces at the proximal and distal ends 66, 68 have a generally circular or oval cross section. Depending upon the angle of the cut line 52 in relation to the strand 50, the planar faces may have a cross-sectional area the same as or greater than that of the nominal cross-sectional area of the corresponding leg sections.

The strands may be formed from any resilient material with generally uniform properties. Cellular polymer materials, such as flexible, open cell polyether or polyester polyurethane foams, are preferred. Other materials include cross-linked polyethylenes, polyolefins, and rebonded or recycled foams.

Cellular polyurethane structures typically are prepared by generating a gas during polymerization of a liquid reaction mixture comprised of a polyester or polyether polyol, a polyisocyanate, a surfactant, catalysts, and one or more blowing agents. The gas causes foaming of the reaction mixture to form the cellular structure.

Polyurethane foams with varying density and hardness may be formed. Hardness is typically measured as IFD ("indentation force deflection") or CFD ("compression force deflection"). Tensile strength, tear strength, compression set, air permeability, moisture resistance, fatigue resistance, and energy absorbing characteristics may also be varied, as can many other properties. Specific foam characteristics depend upon the selection of the starting materials, the foaming process and conditions, and sometimes on the subsequent processing.

The engineered shaped filling elements according to the invention do not shift or form pockets when used as filling materials in cushion casings. Unlike fiber fill, the filling elements may be blown into a large cushion casing without first segmenting the casing with ticking. The filling elements do not take on a compression set, but rebound after being subjected to loads.

Per unit weight and per unit volume, the filling elements of the invention offer cushioning properties greater than that provided by fiber fill. When cushions filled with equivalent volume amount of fiber fill and cushions filled with the filling elements of the invention are subjected to equivalent dynamic and static loads, the cushions with the filling elements of the invention recover their height more completely and more rapidly than fiber-filled cushions. Load to half height tests and fatigue tests confirm the filling materials of the present invention perform better than the equivalent volume amount of fiber fill.

FATIGUE TEST

Sample 1: Filling element according to FIG. 3.

Sample 2: Fiber fill (12 denier).

Separate cushions were filled with equivalent volume amounts of each sample material and the cushion height was measured. The cushions were then subjected to a fatigue test in which they were compressed and released through a number of cycles to simulate ordinary household use of a furniture cushion. After the various compression cycles were completed, the cushion height was measured. Those measurements are reported in the Table below:

| | Sample 1 | Sample 2 |
|---|---|---|
| Initial height | 8.750 in. | 9.250 in. |
| After 20,000 cycles | 8.000 in. | 8.625 in. |
| After 40,000 cycles | 8.000 in. | 7.375 in. |
| After 60,000 cycles | 8.000 in. | 7.375 in. |
| After 80,000 cycles | 8.000 in. | 7.375 in. |
| After 100,000 cycles | 8.000 in. | 7.375 in. |
| % Height retention after 100,000 cycles | 91.4% | 79.7% |

As demonstrated in the fatigue test, the cushion material of sample 1 showed greater height retention than the prior art fiber fill.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

We claim:

1. A filling element for insertion into a casing to form a cushion, pillow or upholstered article, comprising:

a flexible, open cell foam with an indentation force deflection in the range of about 4 to about 15 pounds, shaped into a bent strand having a prozimal end and a distal end, and having a length measured from the proximal end to the distal end, and having a thickness measured in cross-section of the strand, wherein the length is greater than the thickness, and wherein the filling element is insertable into the casing by blowing.

2. The filling element of claim 1, wherein the foam is selected from the group consisting of polyether polyurethane foams, polyester polyurethane foams and rebonded foams.

3. The filling element of claim 1, wherein the foam is polyether polyurethane foam having a density in the range of about 0.6 to 1.2 pounds per cubic foot.

4. The filling element of claim 1, wherein the bent strand forms a Z-shape along a portion of its length.

5. The filling element of claim 1, wherein the bent strand forms an S-shape along a portion of its length.

6. The filling element of claim 1, wherein the bent strand forms a V-shape along a portion of its length.

7. The filling element of claim 1, wherein the bent strand forms a C-shape along a portion of its length.

8. The filling element of claim 1, wherein the length of the strand is within the range of 2.0 to 5.0 inches.

9. The filling element of claim 1, wherein the length of the strand is about 5 to 20 times greater than the cross-sectional thickness of the strand.

10. The filling element of claim 1, wherein the bent strand is bent at least at one position along its length to an angle of about 15 to about 120 degrees.

11. The filling element of claim 10, wherein the bent strand is bent at least at one position along its length to an angle of about 30 to about 40 degrees.

12. The filling element of claim 4, wherein the bent strand forms a Z-shape having generally straight legs depending at bent angles from a generally straight center section and wherein the distal end and proximal end of the strand each have planar faces.

13. The filling element of claim 12, wherein at least one of the faces is formed other than at an angle perpendicular to the leg such that the face has a cross-sectional area greater than the nominal cross-sectional area of the leg.

14. The filling element of claim 5, wherein the bent strand forms an S-shape having generally curved legs depending at bent angles from a generally curved center section and wherein the distal end and proximal end of the strand each have planar faces.

15. The filling element of claim 14, wherein at least one of the faces is formed other than at an angle perpendicular to the leg such that the face has a cross-sectional area greater than the nominal cross-sectional area of the leg.

16. A cushion, comprising a casing having at least a portion filled with a plurality of the filling elements of claim 1.

17. A pillow, comprising a casing having at least a portion filled with a plurality of the filling elements of claim 1.

18. A bed pillow, comprising a casing having at least a portion filled with a plurality of the filling elements of claim 1.

19. An upholstered article, comprising a casing having at least a portion filled with a plurality of the filling elements of claim 1.

* * * * *

UNITED STATES PATENT AND TRADEMARK OFFICE

CERTIFICATE OF CORRECTION

PATENT NO. : 6,235,391 B1
DATED : May 22, 2001
INVENTOR(S) : Jose D. M. Contreras et al.

It is certified that error appears in the above-identified patent and that said Letters Patent is hereby corrected as shown below:

Column 5, claim 1,
Line 61, "prozimal" should read -- proximal --

Signed and Sealed this

Twenty-second Day of January, 2002

*Attest:*

*Attesting Officer*

JAMES E. ROGAN
*Director of the United States Patent and Trademark Office*